United States Patent [19]

Wood

[11] Patent Number: 4,754,818

[45] Date of Patent: Jul. 5, 1988

[54] METHOD OF MEASURING DRILL BIT FLUID FLOW

[76] Inventor: Roy W. Wood, 119 Persimmon St., Birmingham, Ala. 35214

[21] Appl. No.: 110,548

[22] Filed: Oct. 16, 1987

Related U.S. Application Data

[63] Continuation of Ser. No. 901,068, Aug. 26, 1986, abandoned.

[51] Int. Cl.[4] ..... E21B 21/08

[52] U.S. Cl. ..... 175/48

[58] Field of Search ..... 175/48, 69, 70, 337, 175/339, 393; 73/37.9, 149, 861.61

[56] References Cited

U.S. PATENT DOCUMENTS 2,862,387 12/1958 Webster ..... 73/861.61 X 3,422,672 1/1969 Payne ..... 73/151

*Primary Examiner*—Stephen J. Novosad

*Assistant Examiner*—William P. Neuder

*Attorney, Agent, or Firm*—John K. Donaghy

[57] ABSTRACT

A drill bit having cutting cones is provided with a plenum chamber communicating with orifices for supplying lubricants to the bearings of the cutting cones and orifices communicating with the plenum for supplying cutting liquid and gaseous fluid to jet nozzles on the periphery of the drill bit for supplying a low volume of said cutting liquid and gaseous fluid to the area below the drill bit cutting cones thus reducing the velocity of the cuttings and orifice communicating with the plenum chamber and a meter for measuring the volume of cutting liquid and gaseous fluid being supplied to the drill bit.

1 Claim, 2 Drawing Sheets

METHOD OF MEASURING DRILL BIT FLUID FLOW

This application is a continuation of application Ser. No. 901,068, filed 8/26/86, now abandoned.

BACKGROUND OF THE INVENTION

1. Field of the Invention

This invention pertains to a drill bit for drilling earth bores in earth formations utilizing a drill bit having means to divide the gaseous fluid or liquid flow and directing said divided gaseous fluid or liquid flow to the drill bit cones for cooling and lubricating same and to the area adjacent the cuttings for conveying said cuttings to the surface.

2. Background of the Prior Art

The prior art discloses drill bits attached to a rotary drill system which includes hollow drill strings attached to the drilling device above ground. The hollow drill strings permit passage of either drilling mud or gaseous drilling fluid such as air entrained with water to the drill bit to function as a cooling medium for the drill cones and bearings and as a medium for conveying the cuttings to the surface. Such drill bits contain openings, nozzles and the like for discharging the drilling fluid from the drill bit to and around the surface being drilled to convey dust and cuttings away from the cutting area and the drill bit cones to the surface.

SUMMARY OF THE INVENTION

The drill bit of the present invention is unique in its ability to divide the flow of drilling liquid or gaseous fluid at the lowermost possible point above the drill bit cutting cones to reduce the erosion on the cutting cones and bearing skirts due to the abrasive nature of the cuttings which must be conveyed away from the cutting cone area thus reducing the sandblasting effect of the cuttings.

Another object of the present invention is to provide a plurality of jet nozzles on the drill bit leg which directs drilling fluid or gaseous materials toward and away from the hole being cut thus reducing the sandblasting effect of the cuttings on the drill bit cones and conveying the cuttings away from the drill bit cones to the surface.

It is yet another object of this invention to provide the flow of drilling liquid or gaseous fluid at the lowermost possible point above the drill bit cutting cones to reduce erosion of the cutting cones and bearing skirts by the cuttings or sandblasting effect of the cuttings and dust.

And still another object of this invention is to provide a constant volume of drilling liquid or gaseous fluid sufficient to keep dust and cuttings in suspension as they are exhausted from the hole being drilled.

Yet another object of this invention is to provide a drill bit so constructed that the amount of liquid or gaseous fluid in the cutting cone area is reduced thus reducing the cutting velocity of the cuttings and dust while at the same time maintaining full volume for expelling the cuttings and dust and thereby reducing erosion on the cutting cones.

And still another object of this invention is to provide a means for measuring the volume of air or gaseous fluid delivered to the drill bit.

These and other objects of this invention will become apparent to those skilled in the art to which the invention pertains from a reading of the following specification when taken in light of the annexed drawings.

DETAILED DESCRIPTION OF THE PREFERRED EMBODIMENT OF THE INVENTION

Figure 1:
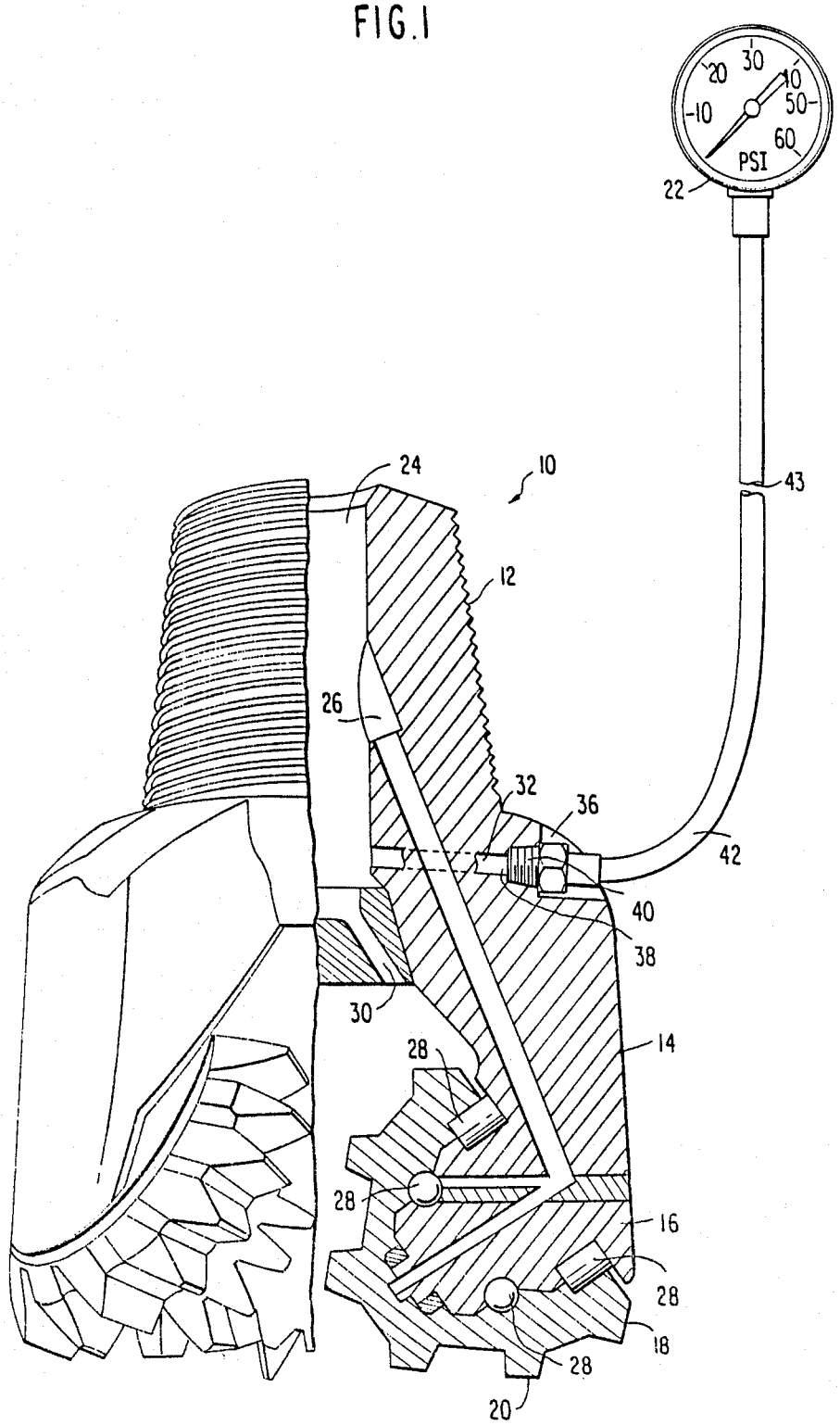
FIG. 1 is a perspective view in section of a drill bit of this invention showing divided passageways for drilling liquid or gaseous fluid and a meter for testing the volume of such liquid and fluid reaching the drill bit.
Figure 2:
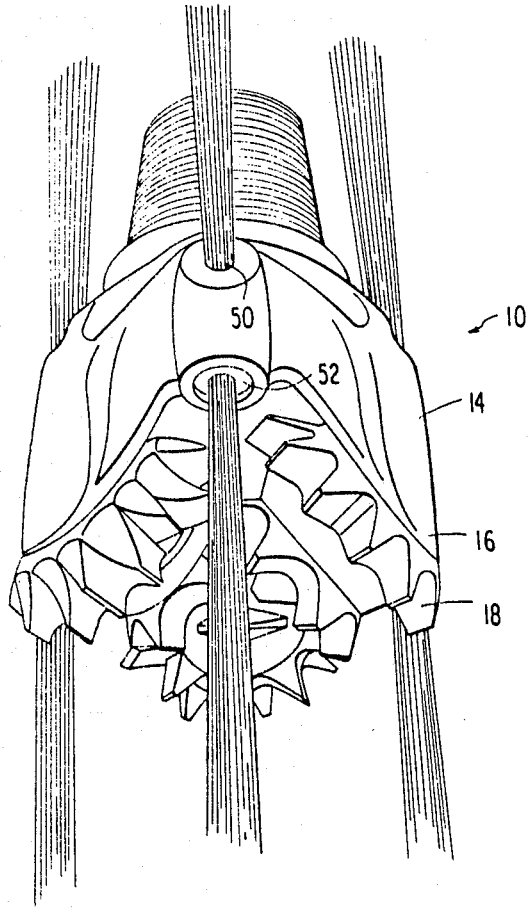
FIG. 2 is a perspective view in section of the drill bit showing the jet nozzles for directing drilling liquid or gaseous fluid toward and away from the hole being drilled.

Turning now in more detail to the drawings, FIG. 1 shows a drill bit 10 having a threaded shank portion 12, a bit leg portion 14, a skirttail portion 16, drill bit cones 18 having a plurality of teeth 20 and a gage 22 connected to the drill bit 10 for testing the volume of cutting liquid or gaseous fluid being supplied to the drill bit for cooling, lubricating and conveying the cuttings to the surface. The testing occurs either (1) prior to the drill bit entering the earth formation or (2) after the drill bit has been withdrawn from the bore.

As is common in this technology, the threaded shank portion 12 is threaded into the threaded end portion of the end drill string of the drilling system. The drill strings are hollow and supply cutting liquid or gaseous fluid into the plenum chamber 24 for distribution through the orifice 26 to the cutting cone bearings 28. Also communicating with the plenum 26 are a plurality of jet nozzles 30 which directs air into the vicinity of the area being cut so that dust and cuttings are conveyed from the bottom of the hole to the surface. Communicating with the plenum 24 is a laterally extending orifice 32 which extends through the bit and opens adjacent the shoulder 36 of the skirt portion 14. The opening 38 has countersunk plug 40 which is threadedly installed for easy removal in the opening 36. A flexible line 42 having an orifice 43 is connectable at one end to the threaded plug and facilitates communication to the plenum chamber 24. The other end of the flexible line 42 has a meter 22 which reads the volume of air or gaseous fluid being delivered to the cutting cone bearings 28 and jet nozzles 30 either (1) prior to the drill bit entering the earth formation or (2) after the drill bit has been removed from the bore. It will be appreciated that with this construction, it is not necessary, as in the prior art, to remove the drill bit from the drill string either (1) prior to the drill bit entering the earth formation or (2) after the drill bit has been removed from the bore to measure the volume of air or gaseous fluid being supplied to the drill bit with a flow meter as well known in the industry. This feature is important inasmuch as it permits measuring the volume of air and gaseous fluid at the drill bit with minimum downtime. The flexible line 42 and meter 22 are not attached to the drill bit 14 during the drilling of the earth formation.

Figure 3:
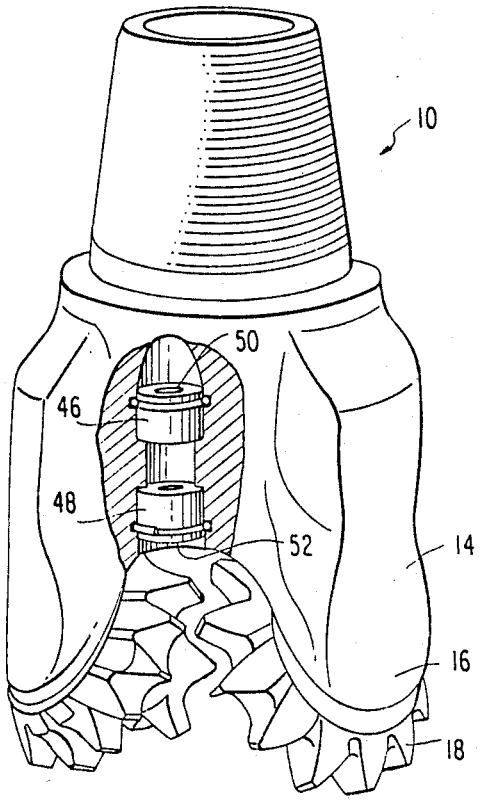
FIG. 3 is a perspective view of the drill bit showing the jet nozzles on the bit leg for directing drilling liquid or gaseous fluid into and away from the hole being drilled.

The passages 30 communicate with the plenum 24 at one end and to lower and upper jet nozzles 48 and 46 respectively, FIG. 3. The jet nozzle 48 has an open orifice at 52 which permits the flow of cutting liquid or gaseous fluid downwardly into the hole being cut. The upper jet nozzle 46 has a similar opening orifice 50 which permits upward flow of cutting liquid or gaseous fluid thereby conveying the cuttings and associated dust away from the cutting cones and up to the surface. The jet nozzles 46 and 48 are placed in vertical orientation but it will be appreciated that side by side orientation is contemplated. Nozzles 46 and 48 are removable whereby nozzles of different size may be used. The different size nozzles permit adjustment of airflow either upwardly or downwardly depending on the earth formation being drilled. This construction insures that the correct amount of airflow and pressure is available at the cutting cones to prevent sand blasting thereon. It will be appreciated that the pressure in the plenum chamber 24 is always constant. The present construction permits the provision of low velocity flow in the area of the cutting cones and a corresponding increase of velocity just above the drill bit body and the drill stem due to the introduction of liquid or gaseous fluid from the upper jet nozzle 46 into upward flow. The reduction of volume of liquid or gaseous fluid below the lower nozzle greatly reduces the cutting velocity of the cuttings and associated dust thus resulting in less wear on the cutting cones.

While the invention has been described with regard to a preferred embodiment thereof, it will be appreciated to those skilled in the art to which the invention pertains that numerous changes may be made in the invention without departing from the spirit and scope thereof.

What I claim is:

1. A method for measuring the volume of cutting liquid or gaseous fluid being supplied to a drill bit for drilling bores in earth formations, wherein the drill bit is attached to the end of a hollow drill string and has a plenum chamber therein for receiving the cutting liquid or gaseous fluid, comprising the steps of:

providing a lateral passage in the drill bit communicating at its inner end with the plenum chamber and opening at its outer end to the exterior of the drill bit;

closing the outer end of the lateral passage with a removable plug;

removing the drill string and drill bit attached thereto from a bore being drilled with the drill bit;

removing the plug from the lateral passage while leaving the drill bit attached to the drill string;

attaching a meter to the passage in place of the plug;

causing a cutting liquid or gaseous fluid to flow through the drill string and into the drill bit plenum chamber; and measuring the flow of the cutting liquid or gaseous fluid being supplied to the drill bit by observing the meter attached to the bit, whereby a determination can be made of the status of such flow without removing the drill bit from the drill string.

* * * * *